US005551590A

United States Patent [19]

Mazur et al.

[11] Patent Number: 5,551,590

[45] Date of Patent: Sep. 3, 1996

[54] NON-METALLIC PRESSURE VESSEL FITTING

[75] Inventors: Mark Mazur, North Kingstown; Joseph F. Silva, Bristol; Albert R. Heilman, West Warwick, all of R.I.

[73] Assignee: Amtrol Inc., West Warwick, R.I.

[21] Appl. No.: 453,656

[22] Filed: May 30, 1995

[51] Int. Cl.[6] ..... B65D 90/10

[52] U.S. Cl. ..... 220/465; 220/404; 220/586

[58] Field of Search ..... 285/921, 205; 220/403, 404, 465, 601, DIG. 1, 661, 581, 586

[56] References Cited

U.S. PATENT DOCUMENTS

| | | | |
|---|---|---|---|
| 2,180,960 | 11/1939 | Kennedy | 285/205 |
| 2,372,800 | 4/1945 | Stearns | 220/3 |
| 2,376,351 | 5/1945 | Gay | 220/3 |
| 2,376,831 | 5/1945 | Stearns | 220/3 |
| 2,454,919 | 11/1948 | Hagan | 220/465 |
| 2,695,753 | 11/1954 | Kirk, Jr. | 237/8 |
| 3,035,614 | 5/1962 | Kirk, Jr. | 138/30 |
| 3,095,993 | 7/1963 | Balcom et al. | 220/5 |
| 3,181,589 | 5/1965 | Phelps | 158/32 |
| 3,247,999 | 4/1966 | Stilwell | 220/465 |
| 3,458,084 | 7/1969 | Laurizio | 285/205 |
| 3,524,475 | 8/1970 | Kirk, Jr. | 138/30 |
| 3,774,802 | 11/1973 | O'Cheskey | 220/85 |
| 3,931,834 | 1/1976 | Caillet | 138/30 |
| 4,220,361 | 9/1980 | Brandenberg | 285/921 |
| 4,589,563 | 5/1986 | Born | 220/3 |
| 4,685,589 | 8/1987 | Benton | 220/465 |
| 4,775,073 | 10/1988 | Webb | 220/256 |
| 4,836,409 | 6/1989 | Lane | 220/403 |
| 5,222,620 | 6/1993 | Lima | 220/404 |

FOREIGN PATENT DOCUMENTS

0415691A1 3/1991 European Pat. Off. .

*Primary Examiner*—Stephen J. Castellano
*Attorney, Agent, or Firm*—Fisher, Christen & Sabol

[57] ABSTRACT

A pressure vessel fitting which is non-metallic, thus, eliminating the need for the soldering, brazing or welding of the fitting which is necessary when conventional metallic fittings are used and, thus, eliminating the corrosion problems often encountered when metallic fittings are used. The pressure vessel fitting has a snap together design which eliminates the loosening problems under vibration which threaded connections are subject to, unless some type of retention or locking device is used. The non-metallic pressure vessel fitting generally comprises three components, namely, an internal fitting, a grommet and a snap retainer.

13 Claims, 3 Drawing Sheets

NON-METALLIC PRESSURE VESSEL FITTING

BACKGROUND OF THE INVENTION

1. Field of the Invention

The invention relates to a new type of fitting for use in pressure vessels. In particular, the invention relates to a pressure vessel fitting which is non-metallic, thus, eliminating the need for the soldering, brazing or welding of the fitting which is necessary when conventional metallic fittings are used. The corrosion problems often encountered when using metallic fittings are, thereby, eliminated. Also, in particular, the invention relates to a pressure vessel fitting having a snap together design which eliminates the loosening problems occurring due to vibration which threaded connections are subject to, unless some type of retention or locking device is used.

2. Description of Related Art

The plastic or non-metallic fitting connections and many of the metallic fitting connections currently in use in the pressure vessel industry are threaded together. Threaded connections are often subject to loosening problems under vibration, unless some type of retention or locking device is used. Metallic fittings are often brazed, soldered, or welded, which can result in corrosion problems.

U.S. Pat. No. 5,222,620 discloses a drum liner locking and locating apparatus for securing a drum liner to a drum. The drum liner apparatus primarily comprises a fitting, a liner, and a non-releasable securing means. The fitting is passed through an opening in the lid of a drum before the lid is attached to the drum. The fitting can only be passed through the opening so that the liner is in a position that the liner can expand to the full size of the drum. After the fitting is in place, the non-releasable securing means fastens the fitting to the drum raising the drum liner to the top of the drum. Consequently, to remove the drum liner, the top of the drum must be removed destroying the drum and prohibiting reconditioning or reuse of the drum. More specifically, the fitting (2) for the the drum (3) has the bottom flange (8) which contains the teeth (10). The gasket (6) fits on the top of the flange (8). The rim of the top hole of the drum (3) is located on the top of the gasket (16). The lock nut (20) holds the rim of the drum (3) in place.

U.S. Pat. No. 3,774,802 discloses apparatus for attaching internal parts to the interior of a pressure vessel having an inner lining of uncured rubber including a rigid fastener, preferably an internally threaded nut, rigidly secured over an opening through the wall of the vessel and the rubber lining. A rigid bolt is threaded through the nut from the inside of the vessel so that a lateral shoulder on the bolt is tightened against the rubber lining. A layer of uncured rubber is mounted over the shoulder, and the layer is cured when the inner lining is being cured to embed the shoulder in the rubber and seal the bolt against leakage. Internal parts are attached to the portion of the bolt inside the vessel, and the structural load applied to the bolt by the internal parts is transmitted to the wall of the vessel through the rigid bolt and nut. More specifically, the internally-threaded nut (16) is welded to the tank wall (10). The bolt (22) inwardly extends past the tank wall (10) and contains the flange (26). The end of the liner (12) is C-shape and fits over the flange (26).

European Published Patent Application No. 0415691 discloses a cap and seal closure for flexible containers. The mouthpiece (4) has the flanges (46, 47) sealed to the inner (82) and outer bags, and the connection plug (48) communicates (11) with the space between. The cap (20) has an inner hollow portion with a three layered metal foil disc. The inner bag (2) is filled via the opening (10). The cap (20) is secured by lodgement of the annular projections (45A, 45B). The disc is then fused to the end face (**45*c*) of the mouthpiece (4). Thereafter, removal of the cap (20**) leaves the disc seal in place retaining the sterlized state of the bag contents, while and until an extractor is fitted. The contents are said not to be exposed during fitting of an extraction device.

U.S. Pat. No. 3,095,993 discloses a seal arrangement for sealing the valve end of the valve body (22) and the end opening of the end cap (14) of the fiberglass tank (10). The lower end of the valve body (22) is T-shaped with the end protrusion thereof being externally threaded. The L-shaped end fitting (21) is internally threaded and mates with the end protrusion of the valve body (22). The rim of the end openings of the end cap (12) fits between the lower rim of the end fitting (21) and the rim of the valve body (22). The O-ring (23) is located between the rim of the valve body (22) and the rim of the end opening of the end cap (14).

U.S. Pat. No. 4,685,589 discloses a composite pressure vessel which includes a fluid port directly through the composite side wall structure formed by internally locating a porting fitting in the side wall structure and then inserting a liner member in the interior of the side wall structure. When thus assembled, a void space is provided between a flange portion on the radial inner end of the porting fitting and the liner member which is completely filled with a sealant. Then a porting hole is drilled through the sealant and liner member from the exterior fitting end. A nut may be threaded onto an exteriorly protruding end portion of the porting fitting and torqued to preload the porting fitting against the composite side wall structure. Also, composite material reinforcement may be applied locally around the protruding end portion and nut. More specifically, note the porting fitting (22) with the flange portion (30) on the inner end of the vessel (2).

Attention is also directed to U.S. Pat. Nos. 4,775,073; 2,376,351; 3,181,589; 4,589,563; 2,376,831 and 2,372,800.

U.S. Pat. Nos. 2,695,753; 3,035,614; 3,524,475; 3,931,834 and 4,836,409, for example, relate to expansion tanks for closed water systems. An expansion tank is divided into two non-communicating chambers by a flexible elastomeric diaphragm. One section is precharged with gas under pressure so that the diaphragm is displaced to increase or decrease the volume of this section according to the variations of the volume of water in the other section. When the expansion tank is incorporated in a hot water heating system, the variation in volume is caused when the boiler water is heated and cooled in the normal cyclic operation of the heating system. If the expansion tank is a part of a water system, the variation in volume occurs as tap water is drawn and when the pump operates to replace the water drawn from the tank. The diaphragm separates the gas in the one section of the tank from the water in the system, thereby eliminating the drawbacks of prior art heating systems or other water systems which result from the absorption of air in the water. The diaphragm type of expansion tank is one in which the inner surface of the portion of the tank defining the water-receiving section is usually covered with a water impervious liner. The liner itself is usually fabricated in a separate operation before being installed in the tank. The water is thus contained between the liner and the diaphragm so that the entire interior of the expansion tank is shielded from the water. As a result, corrosion of the tank is greatly reduced regardless of the type of water with which the tank is used or of the temperature experienced within the practical limits of operation of hot water heating systems. A problem sometimes exists in these types of expansion tanks due to air and/or water leakage at the seals around the water inlet port/fitting.

Note the resilient support (135) in U.S. Pat. No. 4,836,409.

BROAD DESCRIPTION OF THE INVENTION

An object of the invention is to overcome the disadvantages of prior art pressure vessel fittings. Another object of the invention is to provide a pressure vessel fitting which eliminates the need for the soldering, brazing or welding of conventional metallic fittings. Another object of the invention is to provide a pressure vessel fitting which is non-metallic and, thus, eliminates the corrosion problems often encountered when metallic fittings are used. Another object of the invention is to provide a non-metallic pressure vessel fitting which acts as both an air and water seal in a typical application such as when used on a pre-pressurized expansion tank for domestic water systems. A further object of the invention is to provide fitting components which also prevent extrusion of the diaphragm or bladder, used to separate the air and water in such pre-pressurized expansion tanks, through the connection. Other objects and advantages of the invention are set out herein or are obvious herefrom to one skilled in the art.

The objects and advantages of the invention are achieved by the non-metallic pressure vessel fitting of the invention.

The invention involves a non-metallic pressure vessel fitting. The non-metallic pressure vessel fitting generally comprises three components, namely, an internal fitting having an internal passageway and a flange face on which there is a rib and through the center of which a small hole (i.e., the end of the internal passageway) runs, a grommet having two legs and a back portion, and a snap retainer. The elongated body of the internal fitting preferably is cylindrical shaped. The snap retainer has a one way lock lip(s) which may be positioned in the snap lock groove(s) which is located on the internal fitting. The use of an adhesive or chemical bond between the snap retainer and the internal fitting is optional. The snap retainer holds the pressure vessel and the pressure vessel fitting securely together so that this connection cannot be loosened by vibration(s).

Water or liquid systems, particularly the closed system types, often use (pre-pressurized) expansion tanks. The interior of such expansion tanks is divided by a flexible diaphragm into two sections, one of the sections adapted to be precharged by gas under pressure and the other section adapted to receive a liquid, a liner usually covering the interior surfaces of the portion of the tank defining the liquid-containing section, so that the liquid is contained between the diaphragm and the liner. The liquid is usually water.

Pressure control tanks are well known in the prior art and have been used in water supply systems, hot water heating systems or other water systems for many years. Generally, such tanks provide a small quantity of pressurized water to the system upon demand when the pump is off or, when in hot water systems, allow for expansion of the water within the system to avoid damage to pipes, valves, boiler, water heaters, etc.

In its most rudimentary form, such an assembly, commonly referred to as a hydro-pneumatic tank, comprises a tank having connections to the system to allow water to flow into and out of the tank. Air entrapped within the tank is compressed by the rising water level to pressurize the system. However, the large size of such tanks has rendered them impractical for modern applications.

It is known in hydro-pneumatic tanks that pressurized air must be introduced into the tank. This also has drawbacks since some of the air is absorbed by the water and passed into the system. The air in the systems may cause corrosion to develop, the heating of a hot water heating system to be inconsistent, and generate noise or other deleterious characteristics in the system.

The prior art has often resolved this problem to a large extent by installing a flexible diaphragm in the tank to prevent direct contact between the water and the pressurized air. The periphery of the diaphragm is attached to the interior of the tank and it flexes as the quantity of water in the tank increases or decreases. As with any other element in a system containing water, the life span of the accumulator tank is also limited by the effects of corrosion. Water coming into contact with the metal tank causes rust which eventually contaminates the water system and/or causes the tank to leak. Many prior art tanks have minimized or eliminated the corrosion problem by placing a liquid impervious liner or barrier within the tank to prevent contact between the metal tank and the water.

Accumulators in general are chambers wherein incompressible liquid may act upon a compressible medium which maintains the liquid under pressure. Air is preferred to springs as the compressible medium since it is lighter. When air is used, it must be carefully isolated from the liquid since it would dissolve into liquid under pressure and come out of solution when the pressure is relieved, creating troublesome air pockets and bubbles. For this reason a flexible partition is provided between air and liquid. This partition can be in the form of a diaphragm or a bladder.

With regard to the invention, when a pre-pressurized expansion tank having a liner is used, the pressure vessel is sealed by the grommet along four surfaces. A liner may or may not be present. Even if no liner is present and the grommet is placed around the pressure vessel, the sealing functions are similar, as compared to how they are when a liner is present.

Size (i.e., of the system connections) is not a limiting factor in the applicability of the invention design.

There may or may not be relief around the rim of the top surface of the flange of the internal fitting. If present, this relief acts to trap the lower grommet leg, which, in turn, helps to maintain the proper compression or squeeze and to prevent extrusion. The pressure vessel itself is also shaped to maintain the proper compression on the upper grommet leg, to prevent extrusion and to prevent the liner, if present, from being overstressed during operation. Under lower pressure conditions or shorter life cycle applications, the relief on the flange face is not required. The internal fitting is also designed so that the system pressure works to maintain the grommet seal at all times.

The lock lip feature of the invention can be incorporated into the internal fitting, thereby eliminating the need for the separate snap retainer. Proper positioning would be accomplished using the pressure vessel wall.

Relative rotation of the pressure vessel and the pressure vessel fitting is prevented by a non-circular hole which is located in the pressure vessel. The non-circular hole can have any shape.

The internal fitting also acts as a diaphragm support, preventing damage to or extrusion of the diaphragm into the fitting passageway caused by the vessel pre-charge pressure.

The surface of the internal fitting also prevents damage to the diaphragm by eliminating sharp corner bends.

This basic design does not require the use of non-metallic components. Any material, including ferrous and non-ferrous alloys, can be used and performs the required functions.

The design concept of the pressure vessel fitting of the invention is readily adaptable to any bulkhead style fitting. The typical bulkhead style fitting is also a threaded connection. The ability to add one or more washer(s) or spacer(s) allows the invention to be a modifiable standard design. One or more wave washers or belleville springs can be included to help take up slack in the fitting while providing additional pressure on the top of the grommet.

Modifications and changes made to this non-metallic pressure vessel fitting can be effected without departing from the scope or the spirit of the invention. For example, the number of washers or spacers used can be altered without departing from the scope or spirit of the invention. Also, the embodiments of this non-metallic pressure vessel fitting which are illustrated as follows have been shown only by way of example and should not be taken to limit the scope of the claims below.

BRIEF DESCRIPTION OF THE DRAWINGS

In the drawings:

FIG. 4(*b*) is a cross-sectional side view of half of a further embodiment of the pressure vessel fitting including one belleville spring and one spacer or washer;

FIG. 5(*b*) is a plane view of another typical shape of the non-circular top hole which is located in the pressure vessel and which prevents rotation of the invention internal fitting;

FIG. 5(*c*) is a plane view of a further typical shape of the non-circular top hole which is located in the pressure vessel and which prevents rotation of the invention internal fitting;

FIG. 6(*b*) is a plane view of a typical diaphragm support feature geometry;

FIG. 6(*c*) is a plane view of a typical diaphragm support feature geometry.

DETAILED DESCRIPTION OF THE INVENTION

Figure 1:
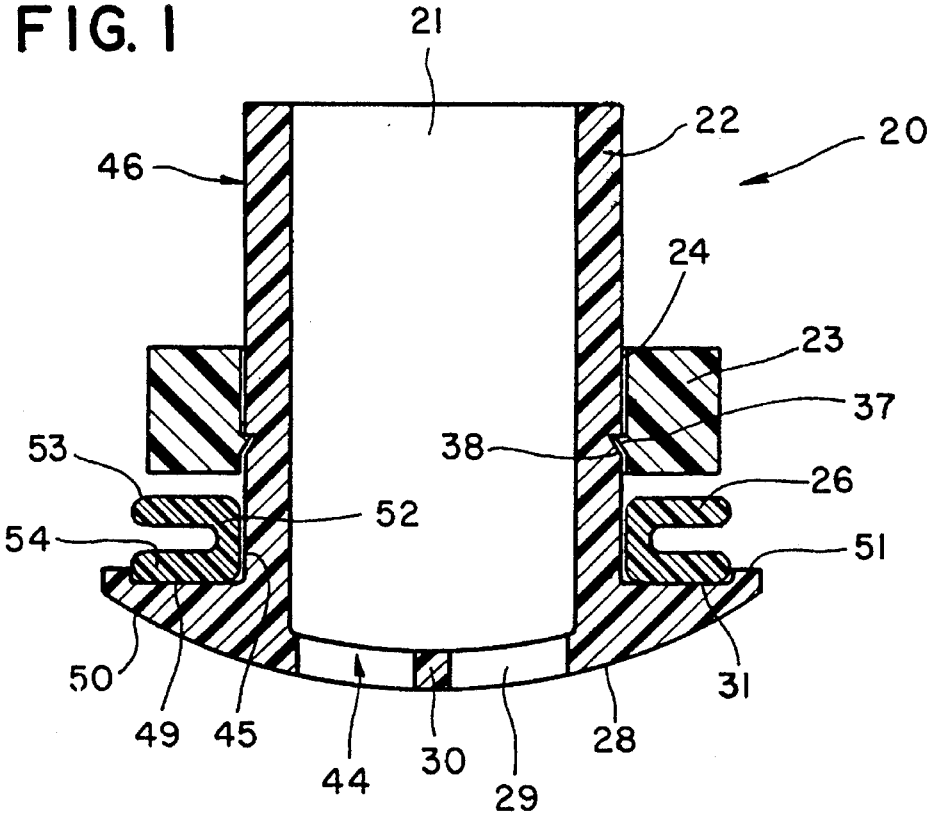
FIG. 1 is a cross-sectional side view of an embodiment of the pressure vessel fitting.

As shown in the accompanying drawings, that is, FIGS. 1 through 7, the non-metallic pressure vessel fitting (20) of the invention generally comprises three components, namely, the internal fitting (22), the grommet (26) and the snap retainer (23). FIGS. 1 to 7 represent preferred embodiments of the invention used in domestic or commercial hot water or pressurized water systems, that are closed or open water systems, which have pre-pressurized expansion tanks.

Expansion tanks, as used in domestic water systems, provide an air surge chamber that accounts for variations in pressure within the system. Tanks of this type are divided into chambers by a flexible diaphragm wherein gas under pressure is contained in one chamber while system water is contained in the other. The water chamber is connected to the water system and changes in pressure are created by the increase and decrease associated with water volume usage in the normal cyclic operation of the system. Expansion tanks of this general type are described in U.S. Pat. Nos. 2,695,753; 3,035,614 and 3,524,475 to C. H. Kirk, Jr. The pertinent portions of U.S. Pat. Nos. 2,695,753; 3,035,614 and 3,5224,475 dealing with such expansion tanks and such water systems is incorporated herein by reference. The pressurized diaphragm-type storage/expansion tanks for well water systems and other water supply/circulation systems can be those marketed under the trademark WELL-X-TROL® by Amtrol, Inc. or any other suitable tanks of that type. The pressure vessel water port fitting is normally located on the bottom end of the expansion tanks. The orientation of the pressure vessel fitting (20) shown in the drawings is only for the convenience of the reader of this document. Most of the expansion tank and the rest of the water system are well known and are not shown in the drawings.

Figure 6A:
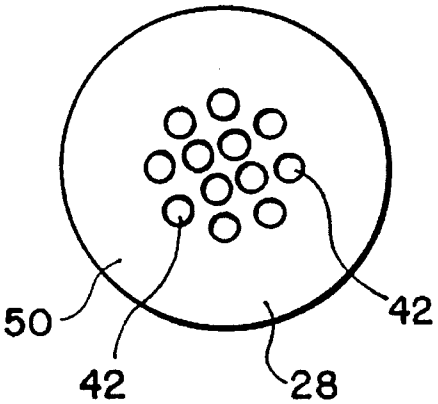
FIG. 6(*a*) is a plane view of a typical diaphragm support feature geometry.
Figure 6B:
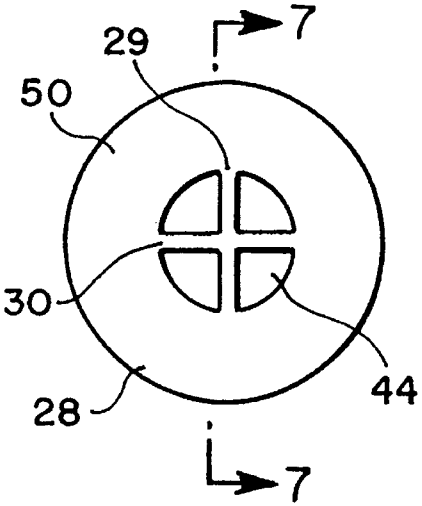
Figure 6C:
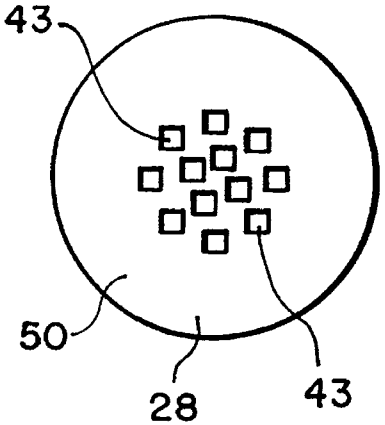
Figure 7:
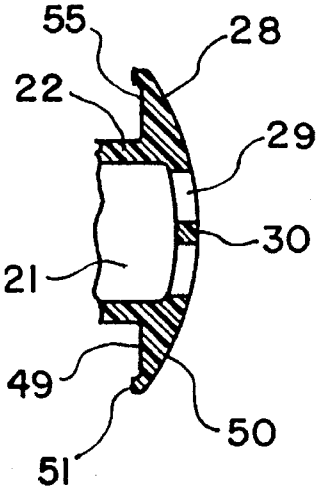
FIG. 7 is a side cross-sectional view along line 7—7 in FIG. 6(*b*) of the bottom portion of the internal fitting of FIGS. 1 and 2 including the flange faces of the internal fitting and the bottom hole with the two ribs.

Referring to FIG. 1, the internal fitting (46) has the elongated central body (22) which is preferably cylindrical in shape and which has the elongated central passageway (21), which has a longitudinal orientation. The latter is a water port. When the pressure vessel fitting (20) is in place in the hole (47) in the top of the pressure vessel (48), there is communication between the inside of the pressure vessel (48) and the elongated central passageway (21), that is, between the interior and the exterior of the pressure vessel (48). See FIG. 2. The end of the central body (22) has the external flange (28). The flange (28) has the top flat surface (49) which is perpendicular to the longitudinal axis of the central passageway (21). The bottom surface (50) of the flange (28) is smooth, preferably convex shaped. The bottom portion of the central passageway (21) constitutes the hole (44), which is shown with a slightly smaller diameter than the central passageway (21). FIG. 7 also shows the lower end of the internal fitting (46); FIG. 7 is a vertical cross-section taken of FIG. 6(*b*). FIG. 6(*b*) is a bottom plane view of the internal fitting (46) shown in FIGS. 1 and 2. As best seen in FIG. 6(*b*), the ribs 29 and 30 form an "X" in the hole or bottom opening (44). The opening (44) actually consists of four openings. The ribs 29 and 30 keep a flexible diaphragm (not shown) in the pressure vessel (48) from moving into the central passageway (21). The ridge or lip (51) is located around the outer edge of the flat top surface (49) of the flange (28). The opening (44) and the ribs (29 and 30) form typical diaphragm support feature geometry.

Figure 2:
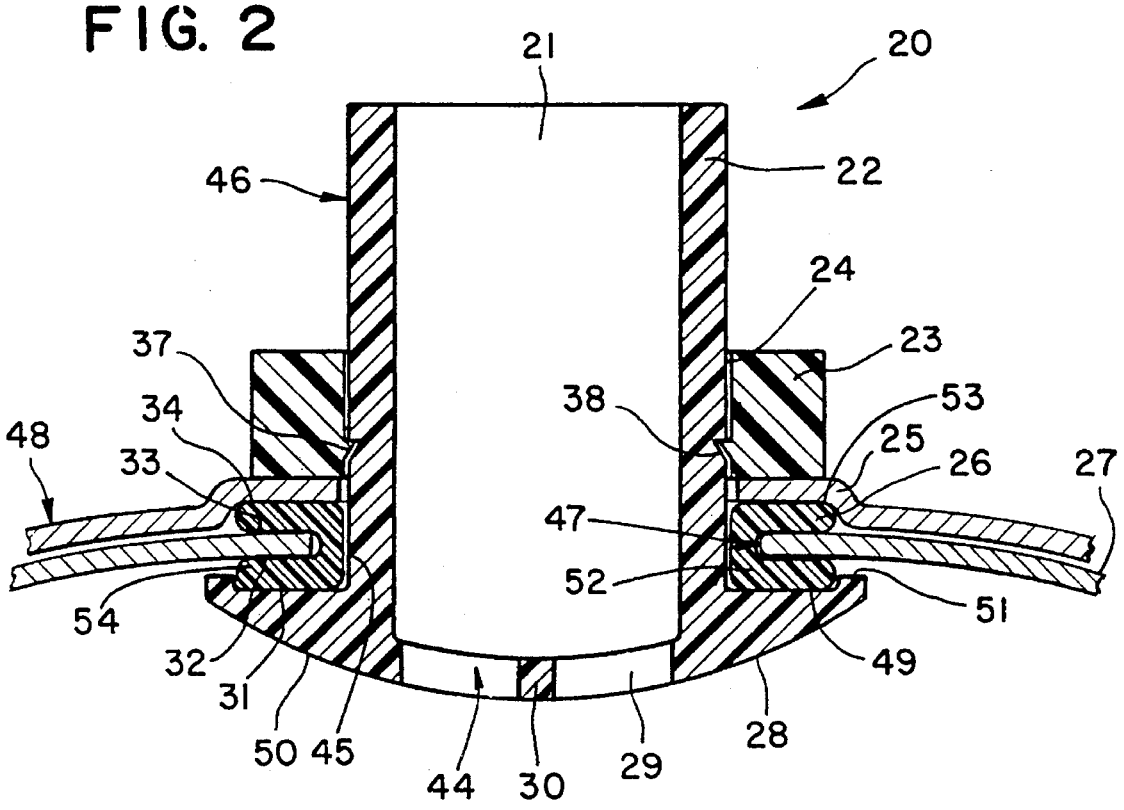
FIG. 2 is a cross-sectional side view of the pressure vessel fitting embodiment of FIG. 1 positioned on a pressure vessel and including a liner.

The invention pressure vessel fitting (20) includes the grommet (26) which is "U" shaped, having the back portion (52), the top leg (53) and the bottom leg (54). The grommet (26) is positioned horizontally in the wide groove (55) formed by the ridge (51), the flat top surface (49) and the corresponding outer surface (45) of the lower portion of the vertical wall of the central body (22). The back portion (52) of the grommet (26) is positioned against the portion (45) of the central body (22) of the internal fitting (46), with the lower leg (54) of the grommet (26) resting against the top surface (49) of the flange (28). As seen in FIG. 2, the central body (22) is also positioned in a hole in the top of the liner (27) located inside of the pressure vessel (25). The legs (53 and 54) of the grommet (26) are positioned around the liner (27). The liner (27) is a barrier layer which is impermeable or impervious to water. An expansion tank diaphragm assembly usually would only have the internal liner (27) in the portion of the tank (48) defined by the flexible diaphragm and containing the water.

The invention pressure vessel fitting (20) includes the snap retainer (23), the back portion of which is slidably positioned against the wall portion (45) of the central body (22). As shown in FIGS. 1, 2, 3, 4(*a*) and 4(*b*), the lower end of the snap retainer (23) can be positioned against the pressure vessel (25), against the grommet (26) directly, or against one or more spacers (35), washers (35) or belleville springs (36). As shown in FIG. 2, the bottom surface of the end portion of the wall (25) of the pressure vessel (48) is located on the top surface of the top leg (53) of the grommet (26). The end portion of the wall (25) is elbowed so as to be positioned away from the liner (27). The phrase "elbowed" means that the end portion of the wall (25) has an outward slanted segment so that the remainder of the end portion is positioned outward from the curvature path of the rest of the wall (25).

Referring to FIG. 2, the snap retainer (23) holds the pressure vessel (48) and the pressure vessel fitting (20) securely together so that this connection cannot be loosened by vibration(s). An adhesive or chemical bond (24) can optionally be used to further increase the strength of the joint between the snap retainer (23) and the central body (22) of the internal fitting (46). The snap retainer (23) is designed with a one-way lock lip (38) which can easily be slipped over the central body (22) of the internal fitting (46) and snapped into position in the snap lock groove (37) on the central body (22). The lock lip (38) has a triangular (preferably a right angle triangular) cross-section, with the right angle side thereof being located towards the top end of the central body (22). The snap lock groove (37) also has a corresponding triangular (preferably a right angle triangular) cross-section. Any suitable adhesive or bonding material (24) to be applied between the snap retainer (23) and the central body (22) would be applied prior to when the one way lock lip (38) of the snap retainer (23) is snapped into position in the snap lock groove (37) on the central body (22). An example of a suitable adhesive (24) is an epoxy resin. As shown in FIG. 2, the snap ring (23) [via the grommet (26) and the flange top surface (49)] holds the ends of the wall (25) of the pressure vessel (48) and the liner (27) sealing relation to the internal fitting (46). The wall (25) is typically constructed of carbon steel.

With regard to the invention, when a pre-pressurized expansion tank is used, the pressure vessel (25) and the fitting (20) are sealed by the grommet (26) along four surfaces. The first sealing surface (31) seals water from the atmosphere. It takes place between the top flange surface (49) of the internal fitting (46) and the lower surface of the lower grommet leg (54). The second sealing surface (32) seals water from pre-charge pressure (air). It occurs between the upper surface of the lower grommet leg (54) and the inner surface of the liner (27). The third sealing surface (33) seals the pre-charge pressure (air) from water. It occurs between the lower surface of the upper grommet leg (53) and the outside surface of the liner (27). The second and third sealing surfaces (32 and 33) act as one seal, both preventing water from leaking into the pre-charge air and preventing the pre-charge air from leaking into water. The fourth sealing surface (34) seals the pre-charge pressure (air) from the atmosphere. It occurs between the upper surface of the upper grommet leg (53) and the inside surface of the pressure vessel wall (48).

Referring to FIG. 2, a sufficient, proper squeeze is applied to both grommet legs (53 and 54) by positioning the one way lock lip (38) of the snap retainer (23) into the snap lock groove (37) located on the central body (22). The relief or ridge (51) on the top flange face (49) of the internal fitting (46) acts to trap the lower grommet leg (54) which helps to maintain the proper squeeze and to prevent extrusion. The end portion of the pressure vessel wall itself (25) is also shaped (as shown in FIG. 2) to maintain the proper squeeze on the upper grommet leg (53), to prevent extrusion and to prevent the liner (27), if present as in FIG. 2, from being overstressed during operation. Under lower pressure conditions or shorter life cycle applications, the relief (51) on the flange top face (49) is not required. The internal fitting (46) and the other components of the pressure vessel fitting (20) are also designed so that the system pressure works to maintain leak tight seals in conjunction with the four sealing surfaces (31, 32, 33 and 34) at all times.

Figure 3:
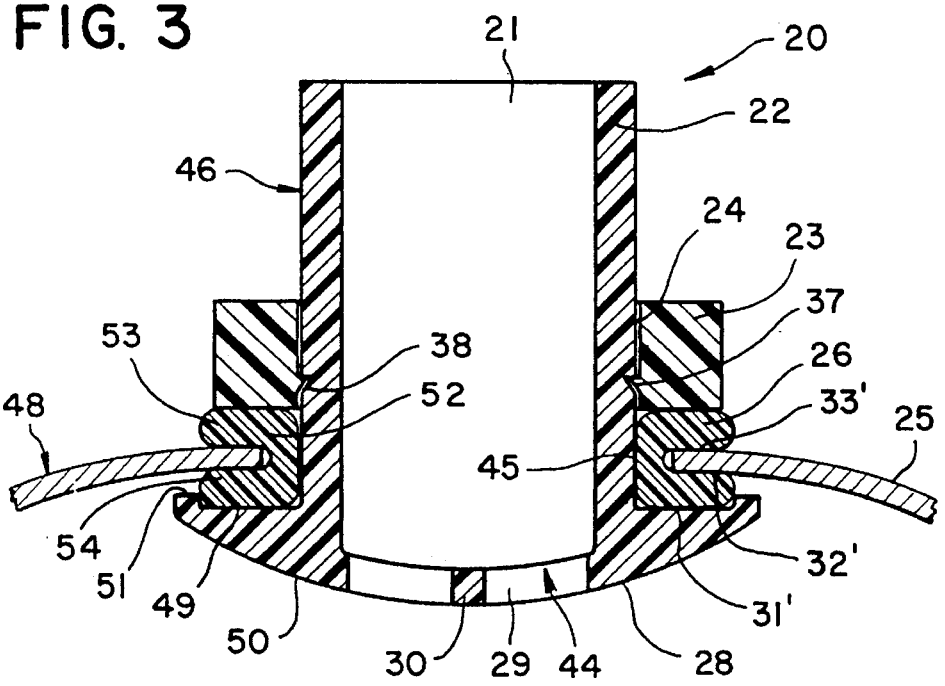
FIG. 3 is a cross-sectional side view of another embodiment of the pressure vessel fitting positioned on a pressure vessel and not including a liner.

Even if no liner (27) is present and the grommet (27) is placed around the end of the pressure vessel wall (25), the sealing functions are similar, as is shown in FIG. 3. The first sealing surface (31') seals water from the atmosphere. It takes place between the top flange surface (49) from the internal fitting (46) and the lower surface of the lower grommet leg (54). The second sealing surface (32') and the third sealing surface (33') seal the pre-charge pressure (air) from the atmosphere. The second seal (32') occurs between the upper surface of the lower grommet leg (54) and the inside surface of the pressure vessel wall (48). The third seal (33') occurs between the lower surface of the upper grommet leg (53) and the outside surface of the pressure vessel wall (48). As shown in FIG. 3, when no liner (27) is present, no elbow or raised end portion in the end portion of the pressure vessel wall (25) is normally used.

Figure 4A:
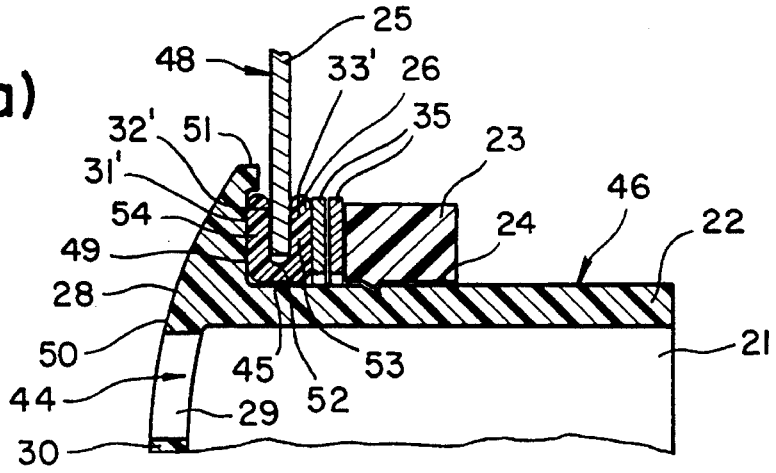
FIG. 4(*a*) is a cross-sectional side view of half of another embodiment of the pressure vessel fitting including two spacers or washers.
Figure 4B:
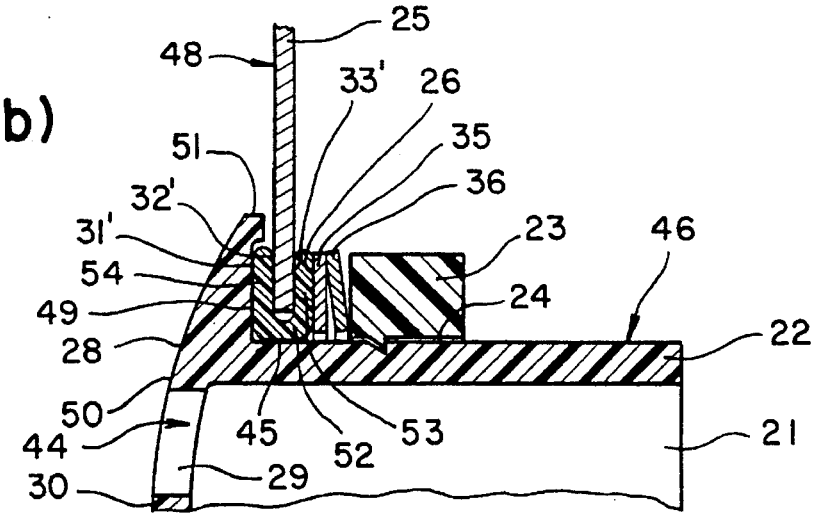

The invention pressure vessel fitting (20) shown in FIG. 4(*a*) is similar to the one shown in FIG. 3, except that two washers or spacers (35) are used to take up any slack or space which may occur between the top surface of the top grommet leg (53) and the bottom surface of the snap retainer (23). While two washers (35) are shown, one, two, three or more washers (35) can be used as are needed. One of the washers (35) can be a wave washer so as to assert more pressure on the top surface of upper grommet leg (53). The wave washer (35) should normally not be located in direct contact with the top surface of the upper grommet leg (53). A wave washer has a profile which is similar to a repeating shallow sine curve (corrugated profile).

The invention pressure vessel fitting (20) shown in FIG. 4(*b*) is similar to the one shown in FIG. 3, except that the washer or spacer (35) and the belleville spring (36) are used to take up any slack or space which may occur between the top surface of the top grommet leg (53) and the bottom surface of the snap retainer (23). The belleville spring (36) should normally not be located in direct contact with the top surface of the upper grommet leg (53).

The lock lip feature of the invention can be incorporated into the internal fitting (22), thereby eliminating the need for the snap retainer (23). Proper positioning would be accomplished using the pressure vessel wall (25).

Figure 5A:
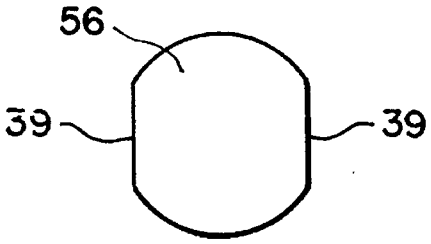
FIG. 5(*a*) is a plane view of a typical shape of the non-circular top hole which is located in the pressure vessel and which prevents rotation of the invention internal fitting.
Figure 5B:
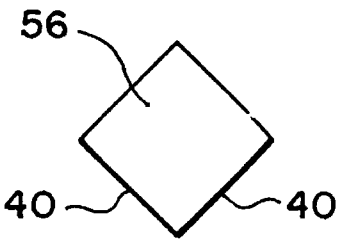
Figure 5C:
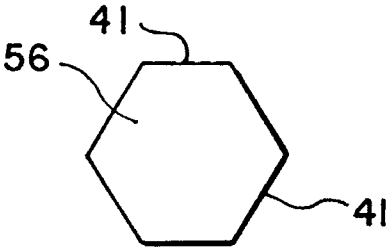

The pressure vessel (48) and the pressure vessel fitting (20) can both be prevented from relative rotation by the non-circular hole (45) which is located in the pressure vessel (48). The non-circular hole (45) can have any shape which will prevent rotation of the pressure vessel fitting (20). Typical examples of such non-circular holes (45) are shown in FIGS. 5(*a*), 5(*b*) and 5(*c*). FIGS. 1, 2, 3, 4(*a*) and 4(*b*) are based upon the circular holes (45), so the horizontal cross-section of the central body (22) of the internal fitting (46) is also circular. The non-circular hole (45) shown in FIG. 5(*a*) is circular with two flat sides (39)—the horizontal cross-section of the central body (22) has the same shape. The non-circular hole (45) shown in FIG. 5(*b*) is square [sides (40)]—the horizontal cross-section of the central body (22) has the same shape. The non-circular hole (45) shown in FIG. 5(*c*) is hexagonal [sides (41)]—the horizontal cross-section of the central body (22) has the same shape. The non-rotational feature of the non-circular holes (45) also causes the use of the same horizontal cross-section shape for the central holes in the grommet (26), the snap ring (23), the washers (35), the belleville spring (36), etc.

The internal fitting (48) also acts as a diaphragm support, preventing damage to or extrusion of the diaphragm caused by the pre-charge pressure. Typical diaphragm support feature geometry is shown in FIGS. 6(*a*), 6(*b*) and 6(*c*). FIG. 6(*a*) shows the replacement of the bottom hole arrangement (44) in FIG. 6(*b*) with a series of the small circular holes (42). FIG. 6(*c*) shows the use of a series of the small square holes (43). The crowned (flange) surface of the internal fitting (48) also prevents damage to the diaphragm (not shown) by eliminating sharp corner bends.

The basic design of the invention does not require the use of non-metallic components. Any material, including ferrous and non-ferrous alloys, may be used and performs the required functions. For example, the grommet (26) can be constructed of suitable resilient material such as relatively hard rubber, or a plastic or polymer material can be used. Size (i.e., of the system connections) is not a limiting factor in the applicability of the invention design. The design concept of the pressure vessel fitting of the invention is readily adaptable to any bulkhead style fitting. The typical bulkhead style fitting is also a threaded connection. The ability to add one or more washer(s) or spacer(s) (35) as is shown in FIGS. 4(*a*) and 4(*b*) allows the invention to be a modifiable standard design. As mentioned above, one or more wave washers (35) or belleville springs (36) can be included to take up slack in the pressure vessel fitting (20).

LIST OF PARTS NUMBERS

In connection with the drawings, the following list of the names of the parts of the invention are noted:

20 pressure vessel fitting;
21 internal passageway in central body (22);
22 central body of internal fitting (46);
23 snap retainer;
24 bond/adhesive (optional);
25 wall of pressure vessel (48);
26 grommet;
27 liner;
28 flange of internal fitting (22);
29 rib;
30 rib;
31 first seal;
31' first seal;
32 second seal;
32' second seal;
33 third seal;
33' third seal;
34 fourth seal;
35 spacer or washer;
36 belleville spring;
37 snap lock groove on internal fitting;
38 one way lock lip of snap retainer;
39 hole flat sides;
40 hole flat sides;
41 hole flat sides;
42 holes;
43 holes;
44 hole in bottom of internal passageway (21);
45 hole in top of pressure vessel (48) and liner (27);
46 internal fitting;
47 hole in top of pressure vessel (48);
48 pressure vessel;
49 flat top surface of flange (28);
50 bottom surface of flange (28);
51 ridge around outer edge of top flange surface (49);
52 back portion of grommet (26);
53 top leg of grommet (26);
54 bottom leg of grommet (26); and
55 groove.

What is claimed is:

1. A pressure vessel fitting for use on a pressure vessel, comprising, in combination:

(a) an internal fitting having an outer surface, an elongated body, an outward-extending flange at the end of said body, and an internal passageway in the elongated body;

(b) a snap retainer having a one way lock lip and being slidable on said elongated body, said internal fitting has a snap lock groove into which said one way lock lip of said snap retainer can be positioned; and (c) a grommet having a back portion, an upper leg and a lower leg, said back portion of said grommet being positioned against the outer surface of said internal fitting.

2. The pressure vessel fitting according to claim 1, wherein said internal fitting, said grommet and said snap retainer are non-metallic.

3. The pressure vessel fitting according to claim 1, wherein each of said internal fitting and said snap retainer is made of a non-ferrous alloy or a ferrous alloy.

4. The pressure vessel fitting according to claim 1, further comprising an adhesive bond between the snap retainer and said outer surface of said internal fitting, when said snap retainer is in the locked position.

5. The pressure vessel fitting according to claim 1, wherein the internal fitting has a crowned or convex surface.

6. The pressure vessel fitting according to claim 1, further comprising at least one washer or spacer and at least one wave washer positioned between said grommet and said snap retainer to take up slack in the fitting therebetween and/or maintain constant force on the grommet seal.

7. The pressure vessel fitting according to claim 1, further comprising at least one washer and spacer and at least one belleville spring positioned between said grommet and said snap retainer to take up slack in the fitting therebetween and/or maintain constant force on the grommet seal.

8. The pressure vessel fitting according to claim 1, further comprising at least one washer positioned between said grommet and said snap retainer to take up slack in the fitting.

9. A combination of a pressure vessel fitting for use on a pressure vessel, and the pressure vessel, comprising:

(a) an internal fitting having an outer surface, an elongated body, an outward-extending flange at the end of said body, and an internal passageway in the elongated body;

(b) a snap retainer having a one way lock lip and being slidable on said elongated body, said internal fitting has a snap lock groove into which said one way lock lip of said snap retainer can be positioned;

(c) a grommet having a back portion, an upper leg and a lower leg, said back portion of said grommet being positioned against the outer surface of said internal fitting; and (d) a pressure vessel.

10. The combination of a pressure vessel fitting for use on a pressure vessel, and the pressure vessel as claimed in claim 9, wherein the pressure vessel has a non-circular hole in it to prevent rotation of the pressure vessel and the pressure vessel fitting.

11. A combination of a pressure vessel fitting for use on a pressure vessel, and the pressure vessel, comprising:

(a) an internal fitting having an outer surface, an elongated body, an outward-extending flange at the end of said body, and an internal passageway in the elongated body;

(b) a snap retainer having a one way lock lip and being slidable on said elongated body, said internal fitting has a snap lock groove into which said one way lock lip of said snap retainer can be positioned;

(c) a grommet having a back portion, an upper leg and a lower leg, said back portion of said grommet being positioned against the outer surface of said internal fitting; and (d) a pressure vessel having a metallic wall and having a hole in the metallic wall, said pressure vessel fitting being positioned in the hole in the metallic wall and the rim of the hole in said metallic wall being positioned between said upper leg and said lower leg of said grommet.

12. A combination of a pressure vessel fitting for use on a pressure vessel, and the pressure vessel, comprising:

(a) an internal fitting having an outer surface, an elongated body, an outward-extending flange at the end of said body, and an internal passageway in the elongated body;

(b) a snap retainer having a one way lock lip and being slidable on said elongated body, said internal fitting has a snap lock groove into which said one way lock lip of said snap retainer can be positioned;

(c) a grommet having a back portion, an upper leg and a lower leg, said back portion of said grommet being positioned against the outer surface of said internal fitting;

(d) a pressure vessel having a metallic wall and having a hole in the metallic wall; and (e) a liner inside of the metallic wall of the pressure vessel, said liner having a hole which corresponds with the hole in the metallic wall, said pressure vessel fitting being positioned in the hole in the metallic wall and in the hole in said liner, the rim of the hole in said liner being positioned between said upper leg and said lower leg of said grommet, and the rim of the hole in said metallic wall being positioned between said upper leg of said grommet and the bottom surface of said snap retainer.

13. The combination of a pressure vessel fitting for use on a pressure vessel, and the pressure vessel according to claim 12, wherein the liner is a partial liner, and wherein there is a flexible diaphragm in and spanning the pressure vessel and having a peripheral engagement along the rim of the partial liner.

* * * * *

UNITED STATES PATENT AND TRADEMARK OFFICE

CERTIFICATE OF CORRECTION

PATENT NO. : 5,551,590

DATED : Sep. 3, 1996

INVENTOR(S) : Mazur et al.

It is certified that error appears in the above-indentified patent and that said Letters Patent is hereby corrected as shown below: On the title page, under

[75] Inventors: Please correct the last name of the third inventor to read as follows: --Heilmann--.

Signed and Sealed this

Twelfth Day of November, 1996

*Attest:*

Bruce Lehman

BRUCE LEHMAN

*Attesting Officer*

*Commissioner of Patents and Trademarks*